US007570877B1

(12) United States Patent
Huang

(10) Patent No.: US 7,570,877 B1
(45) Date of Patent: Aug. 4, 2009

(54) ELECTRIC WATER HEATER THAT KEEPS THE HOT WATER AT A PRESET TEMPERATURE CONSTANTLY

(76) Inventor: Chao-Lin Huang, 70, Huabei 3rd St., Sihu Township, Husi Li, Changhua County (TW)

( * ) Notice: Subject to any disclaimer, the term of this patent is extended or adjusted under 35 U.S.C. 154(b) by 230 days.

(21) Appl. No.: 11/707,779

(22) Filed: Feb. 16, 2007

(51) Int. Cl.
*F24H 1/20* (2006.01)

(52) U.S. Cl. ..... 392/453; 392/452; 392/454

(58) Field of Classification Search ..... 392/452–454
See application file for complete search history.

(56) References Cited

U.S. PATENT DOCUMENTS 1,070,734 A * 8/1913 Rittershaussen ..... 392/341
1,674,369 A * 6/1928 McQuinn ..... 392/450
2,644,432 A * 7/1953 Hummel ..... 122/14.1
2,779,855 A * 1/1957 Sawyer ..... 392/450
2,784,291 A * 3/1957 Harney ..... 392/452
2,804,534 A * 8/1957 Coates ..... 392/452
2,834,865 A * 5/1958 Coates ..... 392/450
3,291,965 A * 12/1966 Hatch ..... 392/450
3,353,000 A * 11/1967 Tomlinson ..... 392/492
3,446,939 A * 5/1969 Lowe et al. ..... 392/452
3,484,580 A * 12/1969 Morgan ..... 392/450
3,638,619 A * 2/1972 Hall et al. ..... 122/14.22
3,962,560 A * 6/1976 Braathen ..... 392/456
4,062,071 A * 12/1977 Blanquet ..... 4/447
4,587,401 A * 5/1986 Ekman ..... 392/495
4,692,592 A * 9/1987 Kale ..... 392/450
5,027,749 A * 7/1991 Cifaldi ..... 122/18.31
5,457,767 A * 10/1995 Frank ..... 392/452
5,809,941 A * 9/1998 Allaire ..... 392/452
5,898,818 A * 4/1999 Chen ..... 392/449
6,148,146 A * 11/2000 Poore et al. ..... 392/452

* cited by examiner

*Primary Examiner*—Thor S Campbell
(74) *Attorney, Agent, or Firm*—Alan Kamrath; Kamrath & Associates PA

(57) ABSTRACT

An electric water heater includes a container, a cold water inlet pipe, a hot water outlet pipe, and a separation board. The separation board includes a first vertical plate having a first end connected to an upper portion of the container, a separation plate having a first end connected to a second end of the first vertical plate, and a second vertical plate having a first end connected to a second end of the separation plate and a second end connected to a lower portion of the container. Thus, the separation board divides the inside of the container into a heat storage space and an instantaneously heating space, so that the hot water from the hot water outlet pipe is kept at a preset temperature.

16 Claims, 9 Drawing Sheets

ELECTRIC WATER HEATER THAT KEEPS THE HOT WATER AT A PRESET TEMPERATURE CONSTANTLY

BACKGROUND OF THE INVENTION

1. Field of the Invention

The present invention relates to a water heater and, more particularly, to an electric water heater.

2. Description of the Related Art

A conventional electric water heater in accordance with the prior art shown in FIGS. 6 and 7 comprises a container 70, and a heating element 71 mounted in the container 70. The inside of the container 70 is divided into a water outlet space 701, a heating space 702 and a storage space 703. The heating element 71 is received in the heating space 702. The lower portions of the heating space 702 and the storage space 703 are connected with each other. A conducting hole 704 is defined between the water outlet space 701 and the heating space 702. A cold water inlet pipe 72 is extended into the storage space 703. A hot water outlet pipe 73 is extended through the heating space 702 and the conducting hole 704 into the water outlet space 701. Thus, the hot water heated by the heating element 71 flows through the conducting hole 704 into the water outlet space 701 and is drained outwardly from the hot water outlet pipe 73. The heat convection between the heating space 702 and the storage space 703 is poor so that the temperature contained in the heating space 702 and the storage space 703 easily produces a temperature differential.

Another conventional electric water heater in accordance with the prior art shown in FIGS. 8 and 9 comprises a container 80, a baffle 81 mounted in the container 80 to divide the inside of the container 80 into a heating space 83 and a storage space 82, a heating element 85 mounted in the heating space 83, a cold water inlet pipe 86 connected to the heating space 83, and a hot water outlet pipe 87 connected to the storage space 82. A conducting space 84 is defined between the baffle 81 and the container 80 and located between the heating space 83 and the storage space 82. Thus, the hot water heated by the heating element 85 flows through the conducting space 84 into the storage space 82 and is drained outwardly from the hot water outlet pipe 87. However, when the water contained in the storage space 82 is exhausted quickly during a short period of time, the cold water contained in the heating space 83 easily flows through the conducting space 84 into the storage space 82.

BRIEF SUMMARY OF THE INVENTION

In accordance with the present invention, there is provided a electric water heater, comprising a container, a cold water inlet pipe having a first end extended into the container and a second end protruded from the container, a hot water outlet pipe having a first end extended into the container and a second end protruded from the container, and a separation board mounted in the container to divide an inside of the container into a heat storage space which is connected to the first end of the cold water inlet pipe and an instantaneously heating space which is connected to the first end of the hot water outlet pipe. The separation board includes a first vertical plate having a first end connected to an upper portion of the container, a separation plate having a first end connected to a second end of the first vertical plate, and a second vertical plate having a first end connected to a second end of the separation plate and a second end connected to a lower portion of the container.

The primary objective of the present invention is to provide an electric water heater that keeps the hot water at a preset temperature constantly.

Another objective of the present invention is to provide an electric water heater, wherein the separation board divides the inside of the container into a heat storage space and an instantaneously heating space, so that the hot water from the hot water outlet pipe is kept at a preset temperature.

A further objective of the present invention is to provide an electric water heater, wherein the heat storage space and the instantaneously heating space of the container form a natural heat convection effect by the first conducting hole and the second conducting hole of the separation board, so that the hot water contained in the container is kept at a constant temperature.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
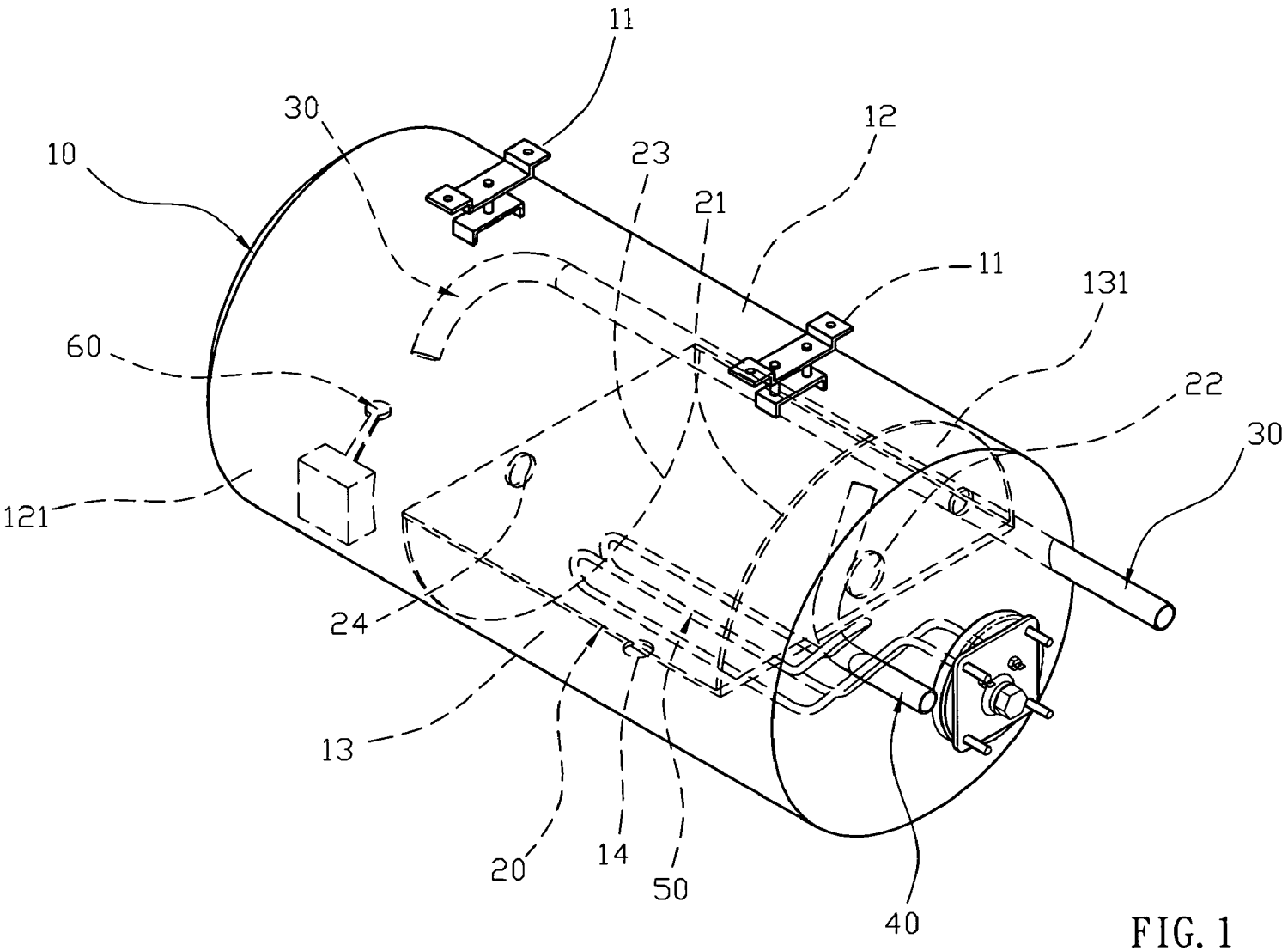
FIG. 1 is a perspective view of an electric water heater in accordance with the preferred embodiment of the present invention.
Figure 2:
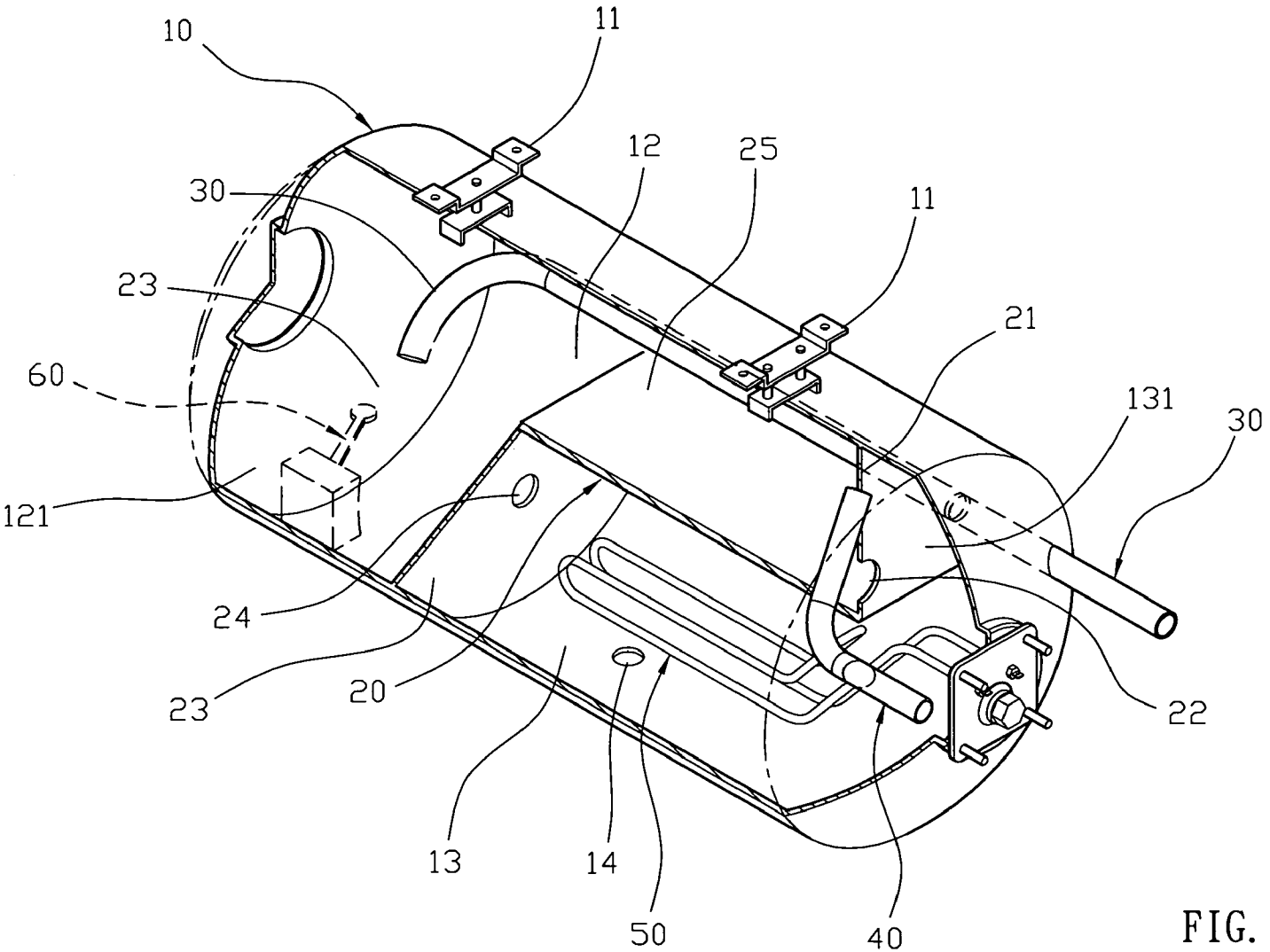
FIG. 2 is a partially cut-away perspective cross-sectional view of the electric water heater as shown in FIG. 1.

Referring to the drawings and initially to FIGS. 1-4, an electric water heater in accordance with the preferred embodiment of the present invention comprises a container 10, a cold water inlet pipe 30 having a first end extended into the container 10 and a second end protruded from the container 10, a hot water outlet pipe 40 having a first end extended into the container 10 and a second end protruded from the container 10, and a separation board 20 mounted in the container 10 to divide an inside of the container 10 into a heat storage space 12 which is connected to the first end of the cold water inlet pipe 30 and an instantaneously heating space 13 which is connected to the first end of the hot water outlet pipe 40.

The separation board 20 has a substantially Z-shaped cross-sectional profile and includes a first vertical plate 21 having a first end connected to an upper portion of the container 10, a separation plate 25 having a first end connected to a second end of the first vertical plate 21, and a second vertical plate 23 having a first end connected to a second end of the separation plate 25 and a second end connected to a lower portion of the container 10. The first vertical plate 21 of the separation board 20 is formed with a first conducting hole 22 connected between the heat storage space 12 and the instantaneously heating space 13 of the container 10. The second vertical plate 23 of the separation board 20 is formed with a second conducting hole 24 connected between the heat storage space 12 and the instantaneously heating space 13 of the container 10.

The container 10 has a side provided with at least one hanging unit 11 to hang the container 10. The heat storage space 12 of the container 10 has a distal end formed with a heat exchange space 121 located beside and connected to the first end of the cold water inlet pipe 30. The instantaneously heating space 13 of the container 10 has an upper portion formed with a high temperature space 131 located beside and connected to the first end of the hot water outlet pipe 40 and the first conducting hole 22 of the separation board 20. The lower portion of the container 10 is provided with a drain hole 14.

A sensor 60 (or detector) is mounted in the container 10 and located beside the first end of the cold water inlet pipe 30. An electric heating element 50 is mounted in the instantaneously heating space 13 of the container 10 and located beside the second conducting hole 24 of the separation board 20. The electric heating element 50 is electrically connected to the sensor 60.

Figure 3:
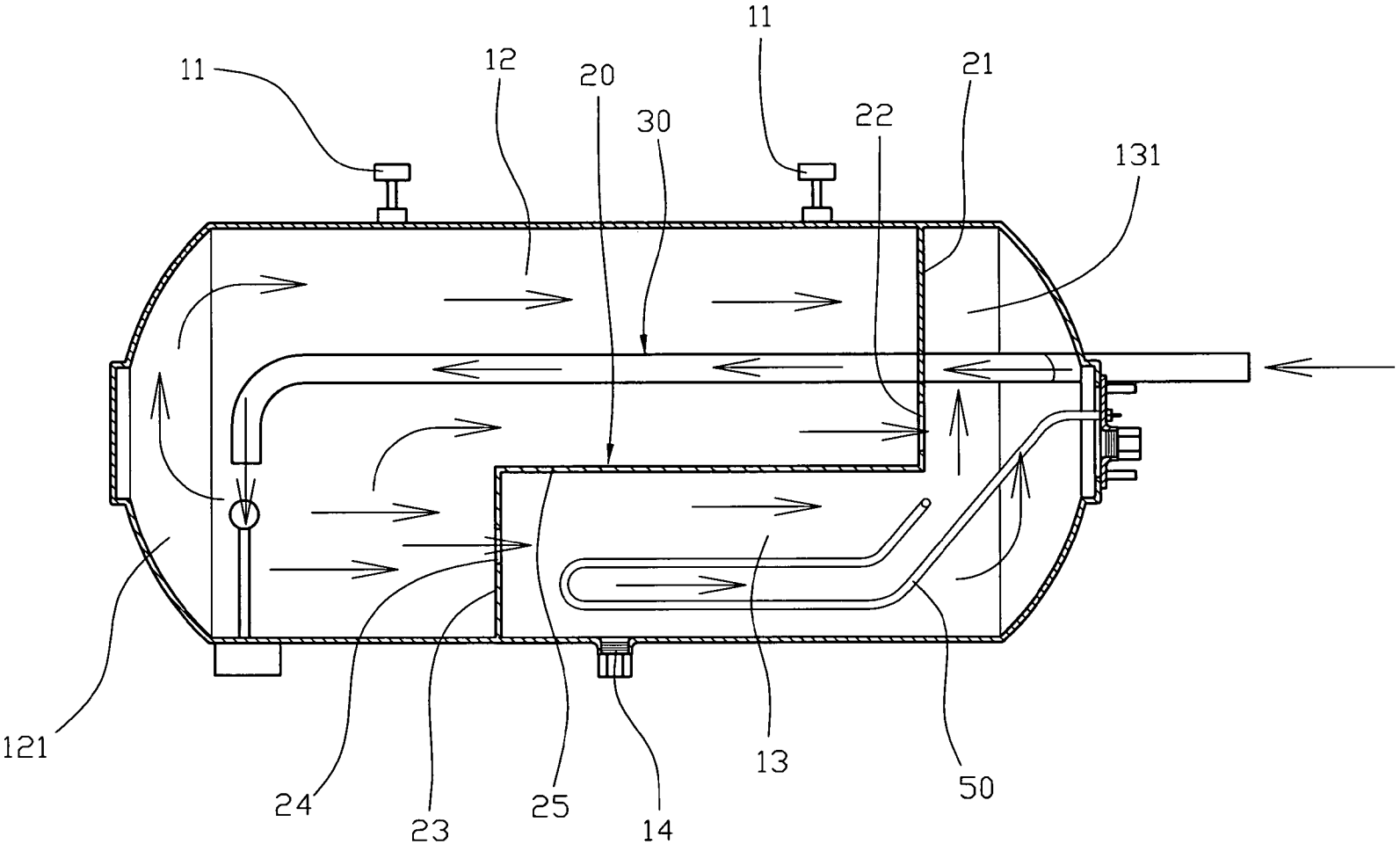
FIG. 3 is a front cross-sectional view of the electric water heater as shown in FIG. 1.

Thus, as shown in FIG. 3, the cold water is introduced from the cold water inlet pipe 30 into the heat exchange space 121 of the heat storage space 12 of the container 10 and is filled with the heat storage space 12 and the instantaneously heating space 13 of the container 10 through the first conducting hole 22 and the second conducting hole 24 of the separation board 20. The water contained in the instantaneously heating space 13 of the container 10 is heated by the electric heating element 50, and the heated water in the instantaneously heating space 13 of the container 10 is introduced through the first conducting hole 22 and the second conducting hole 24 of the separation board 20 into the heat storage space 12 of the container 10 by a heat convection effect, so that the water contained in the container 10 is heated by the electric heating element 50 to reach a preset temperature. When the sensor 60 detects that the water contained in the container 10 reaches the preset temperature, the electric heating element 50 stops operating.

Figure 4:
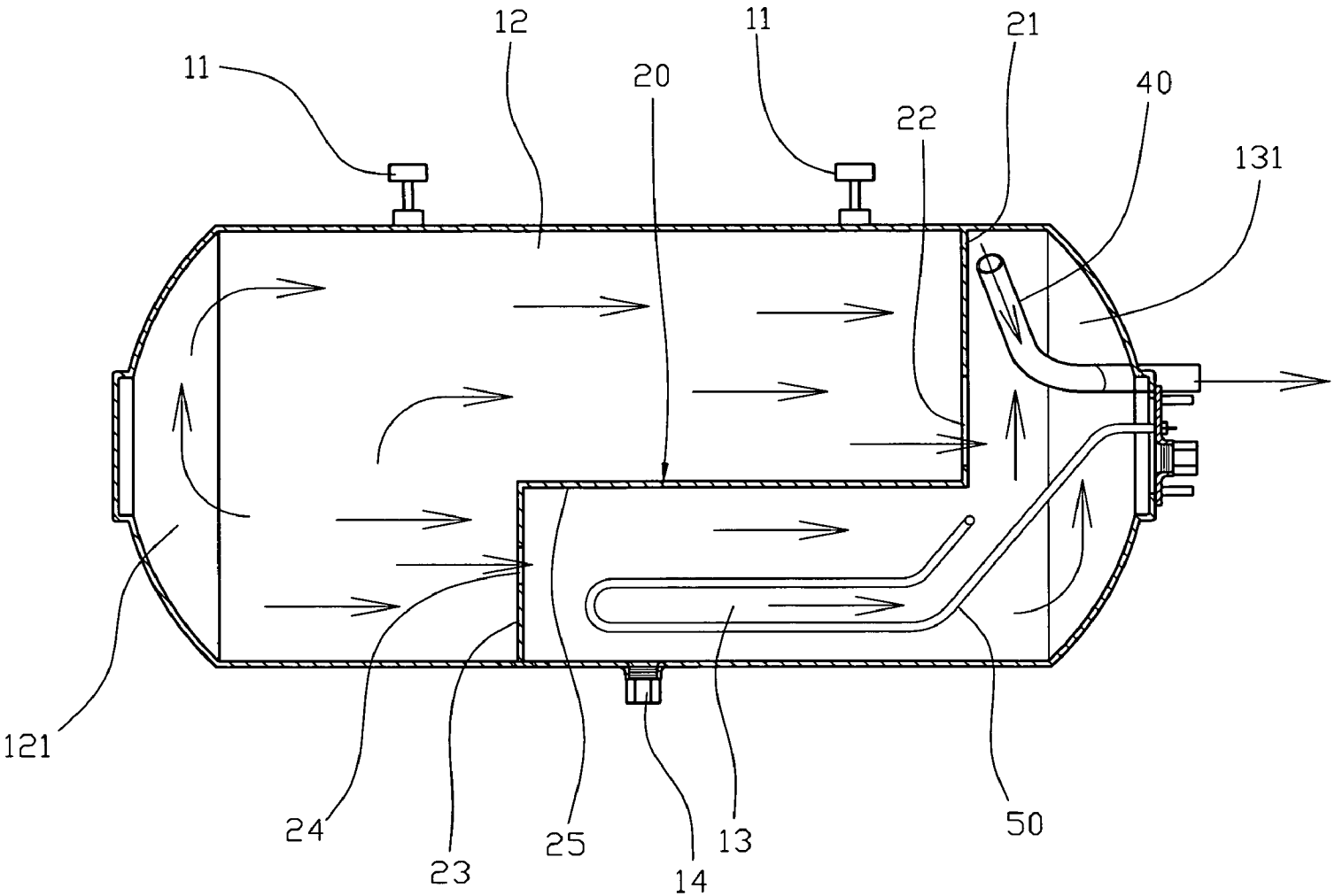
FIG. 4 is another front cross-sectional view of the electric water heater as shown in FIG. 1.

When in use, as shown in FIG. 4, the hot water contained in the high temperature space 131 of the instantaneously heating space 13 of the container 10 is introduced through the hot water outlet pipe 40 for use with a user. Then, the cold water is replenished from the cold water inlet pipe 30 into the container 10 to mix with the hot water in the heat exchange space 121 of the heat storage space 12 of the container 10, and the mixed water is pushed to partially flow through the first conducting hole 22 of the separation board 20 into the high temperature space 131 of the instantaneously heating space 13 of the container 10 and partially flow through the second conducting hole 24 of the separation board 20 and the instantaneously heating space 13 of the container 10 into the high temperature space 131. At this time, the water flowing through the instantaneously heating space 13 of the container 10 is heated by the electric heating element 50 and then conveyed into the high temperature space 131, so that the hot water contained in the high temperature space 131 of the instantaneously heating space 13 of the container 10 is kept at a preset temperature.

Figure 5:
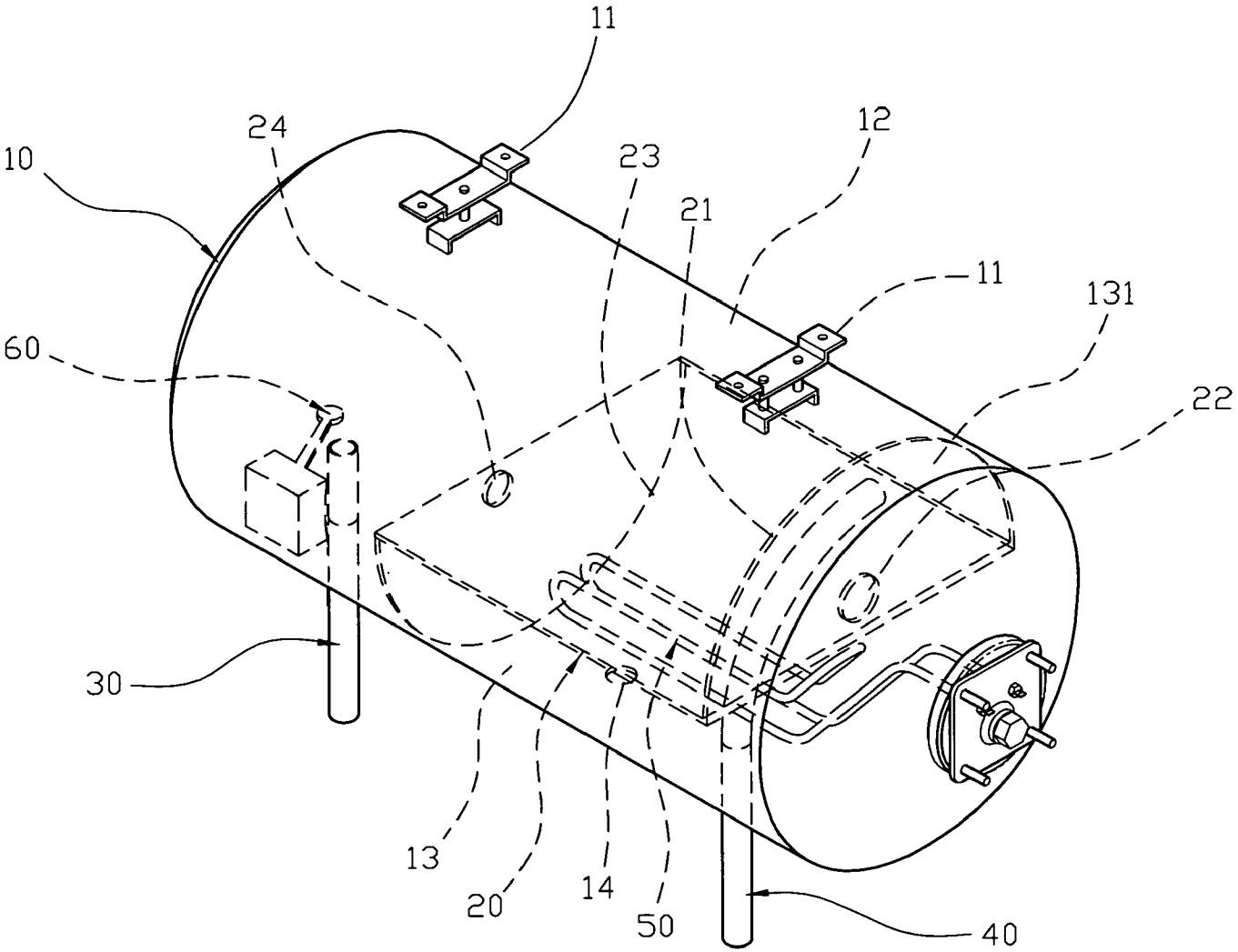
FIG. 5 is a perspective view of an electric water heater in accordance with another preferred embodiment of the present invention.
Figure 6:
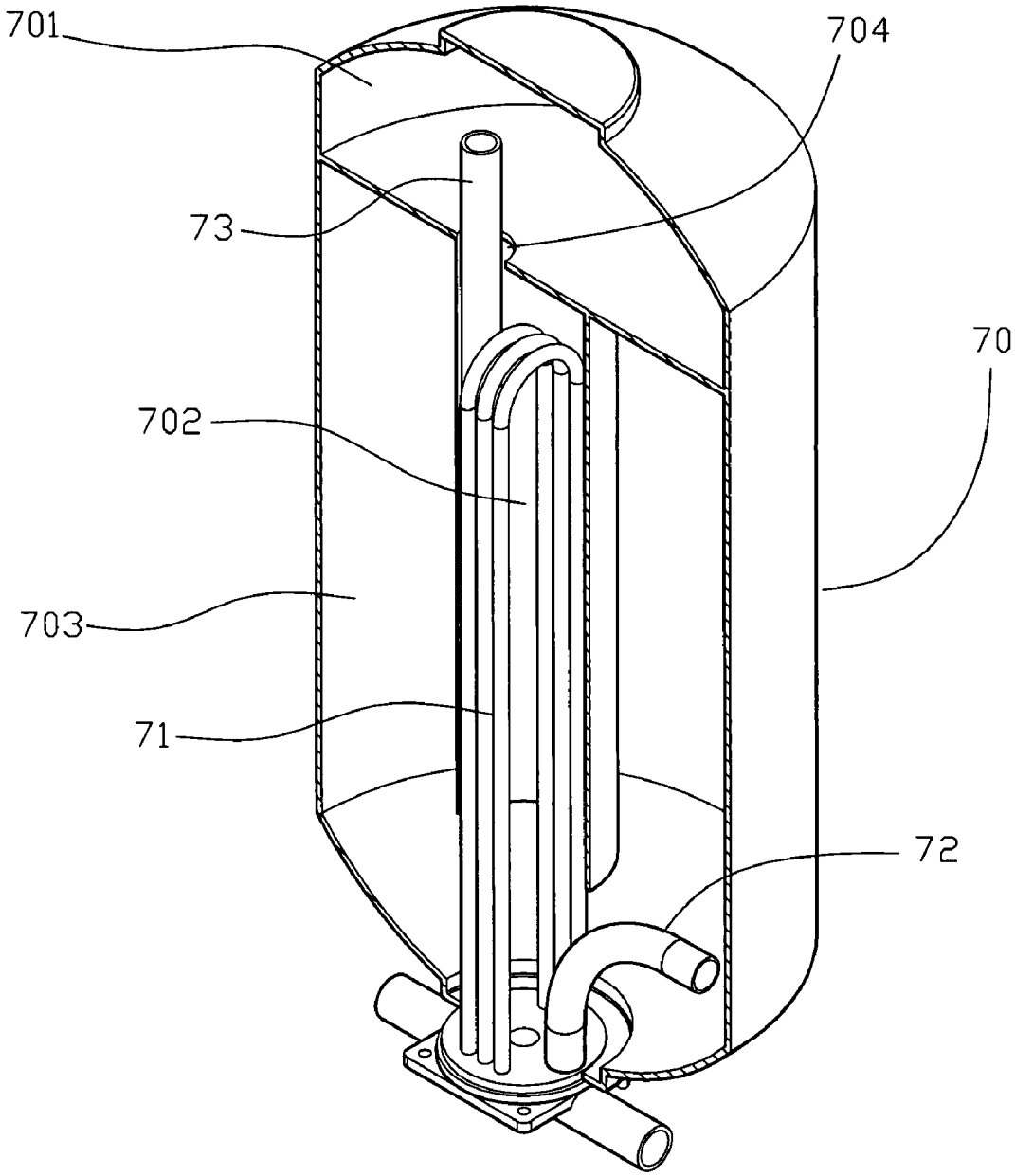
FIG. 6 PRIOR ART
FIG. 6 is a partially cut-away perspective cross-sectional view of a conventional electric water heater in accordance with the prior art.
Figure 7:
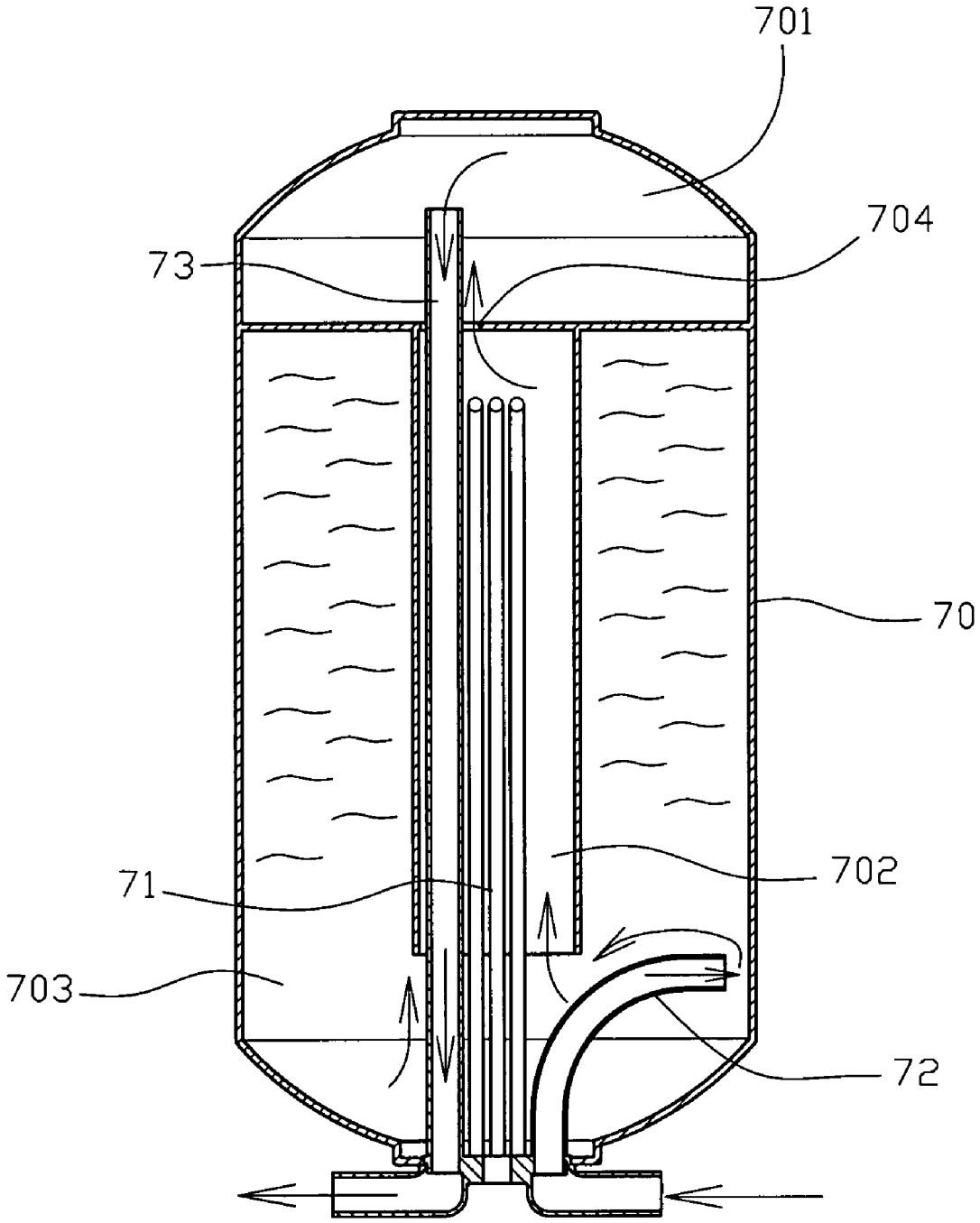
FIG. 7 PRIOR ART
FIG. 7 is a front cross-sectional view of the conventional electric water heater as shown in FIG. 6.
Figure 8:
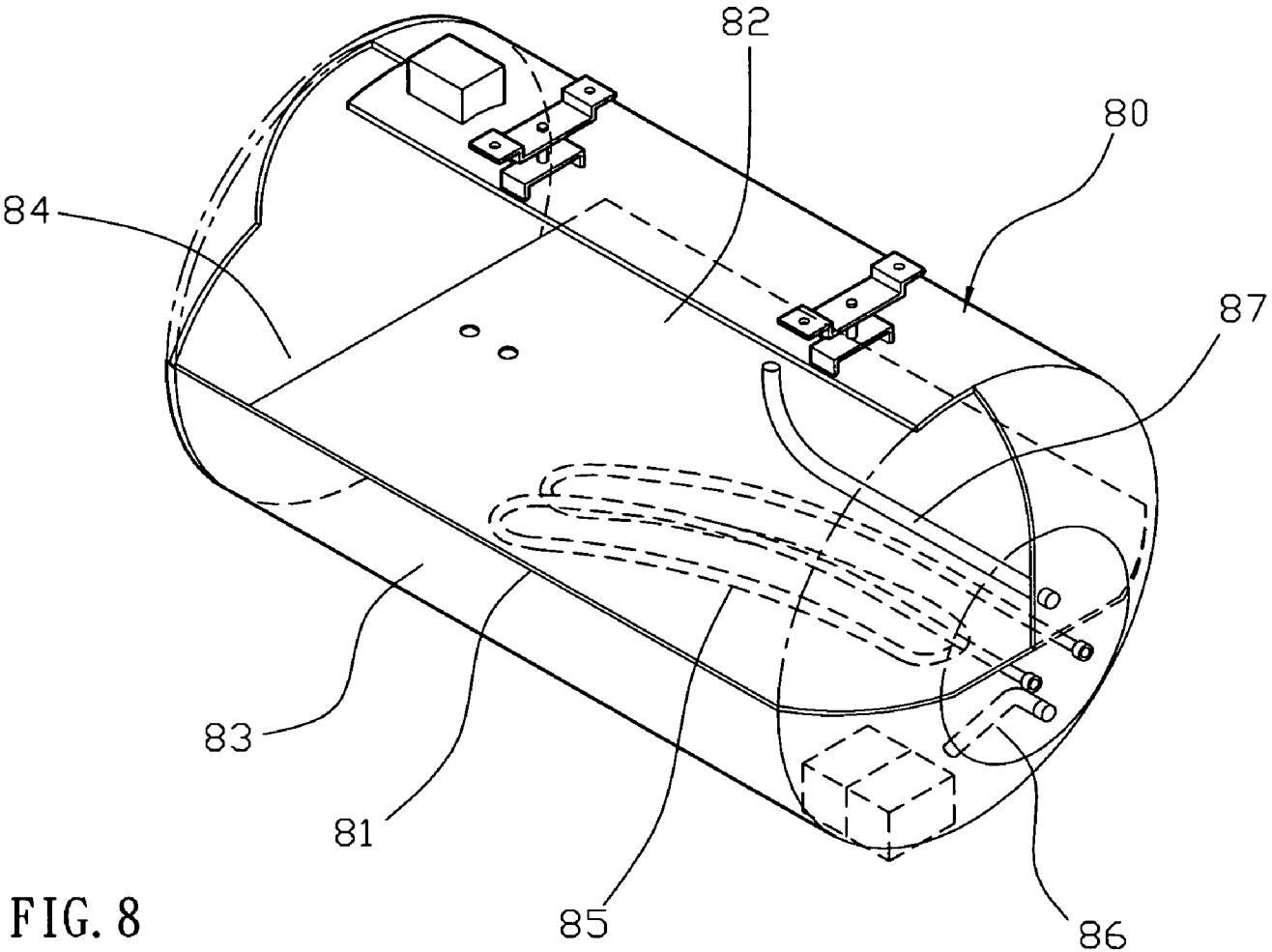
FIG. 8 PRIOR ART
FIG. 8 is a perspective cross-sectional view of another conventional electric water heater in accordance with the prior art.
Figure 9:
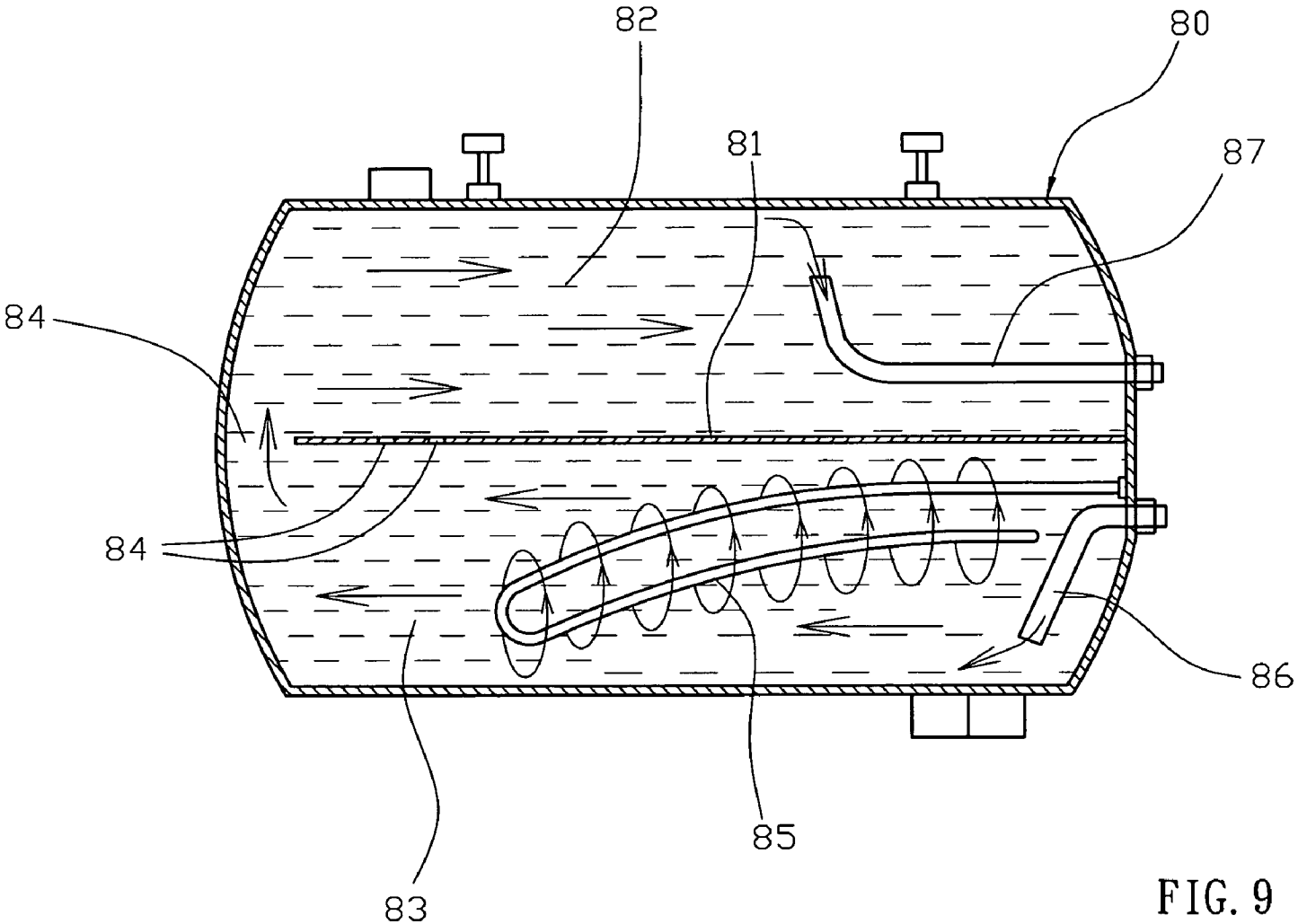
FIG. 9 PRIOR ART
FIG. 9 is a front cross-sectional view of the conventional electric water heater as shown in FIG. 8.

Referring to FIG. 5, the first end of the cold water inlet pipe 30 is extended through the lower portion of the container 10, and the first end of the hot water outlet pipe 40 is extended through the lower portion of the container 10.

Accordingly, the separation board 20 divides the inside of the container 10 into a heat storage space 12 and an instantaneously heating space 13, so that the hot water from the hot water outlet pipe 40 is kept at a preset temperature. In addition, the heat storage space 12 and the instantaneously heating space 13 of the container 10 form a natural heat convection effect by the first conducting hole 22 and the second conducting hole 24 of the separation board 20, so that the hot water contained in the container 10 is kept at a constant temperature.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. An electric water heater, comprising:

a container;

a cold water inlet pipe having a first end extended into the container and a second end protruded from the container;

a hot water outlet pipe having a first end extended into the container and a second end protruded from the container;

a separation board mounted in the container to divide an inside of the container into a heat storage space which is connected to the first end of the cold water inlet pipe and an instantaneously heating space which is connected to the first end of the hot water outlet pipe;

wherein the separation board includes a first vertical plate having a first end connected to an upper portion of the container, a separation plate having a first end connected to a second end of the first vertical plate, and a second vertical plate having a first end connected to a second end of the separation plate and a second end connected to a lower portion of the container;

the first vertical plate of the separation board is formed with a first conducting hole connected between the heat storage space and the instantaneously heating space of the container;

the instantaneously heating space of the container has an upper portion formed with a high temperature space located beside and connected to the first end of the hot water outlet pipe and the first conducting hole of the separation board.

2. The electric water heater in accordance with claim 1, wherein the separation board has a substantially Z-shaped cross-sectional profile.

3. The electric water heater in accordance with claim 1, wherein the second vertical plate of the separation board is formed with a second conducting hole connected between the heat storage space and the instantaneously heating space of the container.

4. The electric water heater in accordance with claim 1, wherein the container has a side provided with at least one hanging unit to hang the container.

5. The electric water heater in accordance with claim 1, wherein the heat storage space of the container has a distal end formed with a heat exchange space located beside and connected to the first end of the cold water inlet pipe.

6. The electric water heater in accordance with claim 1, wherein the lower portion of the container is provided with a drain hole.

7. The electric water heater in accordance with claim 3, further comprising an electric heating element mounted in the instantaneously heating space of the container and located beside the second conducting hole of the separation board.

8. The electric water heater in accordance with claim 7, further comprising a sensor mounted in the container and located beside the first end of the cold water inlet pipe.

9. The electric water heater in accordance with claim 8, wherein the electric heating element is electrically connected to the sensor.

10. The electric water heater in accordance with claim 5, wherein water is introduced from the cold water inlet pipe into the heat exchange space of the heat storage space of the container.

11. The electric water heater in accordance with claim 3, wherein water is filled with the heat storage space and the instantaneously heating space of the container through the first conducting hole and the second conducting hole of the separation board.

12. The electric water heater in accordance with claim 3, wherein heated water in the instantaneously heating space of the container is introduced through the first conducting hole and the second conducting hole of the separation board into the heat storage space of the container.

13. The electric water heater in accordance with claim 1, wherein heated water in the instantaneously heating space of the container is directed toward the high temperature space.

14. The electric water heater in accordance with claim 1, wherein heated water in the high temperature space of the instantaneously heating space of the container partially flows into the hot water outlet pipe and partially flows through the first conducting hole of the separation board into the heat storage space of the container.

15. The electric water heater in accordance with claim 1, wherein the first end of the cold water inlet pipe is extended through the lower portion of the container.

16. The electric water heater in accordance with claim 1, wherein the first end of the hot water outlet pipe is extended through the lower portion of the container.

* * * * *